United States Patent [19]

Taylor

[11] Patent Number: 5,012,702

[45] Date of Patent: May 7, 1991

[54] SPLIT HEAD HAMMERS

[75] Inventor: John D. Taylor, Umberleigh, England

[73] Assignee: Thor Hammer Company Limited, Shirley, England

[21] Appl. No.: 492,421

[22] Filed: Mar. 6, 1990

Related U.S. Application Data

[63] Continuation of Ser. No. 314,763, Feb. 3, 1989, abandoned.

[30] Foreign Application Priority Data

Aug. 6, 1986 [GB] United Kingdom ..... 8619165

[51] Int. Cl.[5] ..... B25D 1/00

[52] U.S. Cl. ..... 81/25; 81/26

[58] Field of Search ..... 81/19, 20, 22, 25, 26; 76/101 D, 103

[56] References Cited

U.S. PATENT DOCUMENTS 2,761,478 9/1956 Guida ..... 81/25 X

FOREIGN PATENT DOCUMENTS 1137125 5/1957 France .

1382408 11/1964 France .

*Primary Examiner*—D. S. Meislin

*Attorney, Agent, or Firm*—Scrivener and Clarke

[57] ABSTRACT

A split head hammer including a head (4) from one end of which a replaceable hammer shaft (2) projects, comprising two head parts (4A, 4B) which can be connected to grip a pair of striking pieces (11) and the shaft (2), the shaft being sunk fully within the head. The head grips the shaft at a plurality of circumferentially-shaped positions (70). Striking pieces suitable also for use in other designs of hammer e.g. solid head and having a rearward extension (46) of smaller section than the open end (21) of the socket can be retained in the socket by plastic flow and/or by a separate retainer, preferably an annular metal washer (50, 60) usefully toroidal (60). Not only the striking pieces (11) but also the shaft (2) can be simply replaced by the user, notwithstanding that the hammer is suited to heavy-duty use.

12 Claims, 6 Drawing Sheets

SPLIT HEAD HAMMERS

This application is a continuation, of U.S. application Ser. No. 07/314,763, filed Feb. 3, 1989 now abandoned.

This invention relates to split head hammers, and in particular to split head hammers with a rigid e.g. metal or plastic head carrying at one but usually at each end a replaceable striking piece.

In a split head hammer, a striking piece is replaced when worn or as required for different hammer applications by separating or "splitting" the head, usually into two main parts. When assembled or re-assembled the parts form a socket or sockets in which the striking piece(s) is/are retained.

The striking piece is conventionally a cylindrical slug of rawhide such as water buffalo rawhide but for applications requiring a striking piece of a different hardness it can be of another firm but malleable material such as leather, rubber, hardwood, a synthetic resinous material and some metals such as copper and aluminium. Often the two striking pieces in a split head hammer are of different materials.

In common with other hammer designs, it is essential in split head hammers that each striking piece is properly gripped in the hammer head, and that the hammer head in turn is safely secured on the hammer shaft, in both cases so that there cannot be unexpected and perhaps dangerous disengagement during use.

One known design of split head hammer in current widespread use for heavy duty applications follows the teaching of Colvin U.S. Pat. No. 562581 (FIG. 3); in the production embodiment the sockets are however of frusto-conical form in that they each comprise a base and sides tapering radially inwardly towards a socket open-end. Each striking piece is respectively positioned to abut the base, which absorbs the hammer impacts, the striking piece being trapped and gripped in the socket by the inwardly tapering socket sides. This retaining arrangement has proved suitable for the softer striking pieces, such as rawhide, since the available closing movement of the parts provides a grip adequate to prevent the striking piece flying free from the head, under the centrifugal forces generated during use, without the need for ridges, spikes or other costly and complicated projections on the inner surface of the socket, whilst allowing the major portion of the striking piece to project from the socket open end for extra working volume.

A disadvantage of this first known design is that the hammer shaft cannot simply be replaced by the user. Another disadvantage is that the head parts are necessarily dissimilar in shape and so expensive to make and to store. A third disadvantage is that this known hammer is complicated to assemble. A fourth disadvantage is that there can be considerable wastage of time and material if during initial assembly the wedges being driven into the shaft end to locate the hammer head safely on the shaft cause the shaft to fracture. Briefly, in this known construction, one head part is of generally T-form with a top section comprising two part-sockets and a hollow shaft-receiving stem, and the other part is of part-cylindrical form comprising two matching part-sockets and a central aperture sized to receive the stem. The hollow stem is externally threaded to receive a nut used to tighten the head parts around the striking pieces. During initial assembly, the nut is fed over the shaft head end, followed by the two head parts (the said other part followed by the said one part), whereafter the shaft head end is "permanently" expanded outwardly against the hollow stem by wedges driven axially into its head end. The shaft is further secured to the one part of T-form by a pin driven through aligned holes in the hollow stem and so through the shaft, with the exposed pin ends then being flattened against the outer surface of the hollow stem.

We have recognised that a desirable feature of this known design is that the shaft is fully sunk between the sockets and so is able to receive directly the impacts from the striking pieces, over a long supported length; and it is one object of our invention to provide a split head hammer which includes a shaft together with a head defining a socket or sockets, in which the shaft extends behind a socket or between the sockets, but yet in which the shaft is removably secured to the head.

Thus according to one feature of our invention we provide a split head hammer including a head and a shaft, the head comprising a first part and a second part, the parts being connected to form at least one striking piece socket, the head including a hollow stem having an open end, the shaft having a portion axially located in and substantially filling the hollow stem and projecting from the open end, the stem extending behind the socket so that impacts taken by the socket from the striking piece are transmitted directly to the shaft characterised in that the stem is formed when the parts are connected together, and in that the stem has a closed end, the closed end having a larger cross section than the open end, and in that the shaft portion has a region which is of larger cross-section than that of the open end. In a preferred construction, the closed end is formed by a pair of end members integral respectively with each head part, and spaced apart by a narrow gap through which the shaft cannot pass i.e. the shaft portion has no cross-section smaller than this gap. Axial slippage of the head along the shaft in one relative direction can thus be prevented by abutment of the shaft head end with the closed end of the socket, the closed end preferably being flat for full facial contact with the end face of the shaft head end, or conical for annular contact over a substantial area of the end face; whilst slippage of the head on the shaft in the other relative direction under centrifugal force during swinging of the hammer in use can be prevented by engagement between the shaft cross-section and the stem cross-section, preferably by the wedging action of a steadily increasing shaft cross-section with a corresponding steadily reducing stem cross-section. With properly selected dimensions, the shaft cannot be removed through the open end of the stem whilst the head parts are connected.

Because the stem is formed by the joining of the head parts, the shaft can be replaced after the head has been split, and is retained when the parts are re-connected. The closed end can also be split, into two sections with one section integral with each head part. This embodiment permits the shaft to be placed in one head part, then the other head part can be secured both to trap the shaft, and to form the sockets and to trap the striking pieces therein, the split being parallel to the shaft axis; furthermore whilst this embodiment greatly eases hammer assembly as compared to the existing prior arrangement described above, we do not exclude, in an alternative embodiment particularly useful for the larger split-head hammers having a handle portion of smaller section than the head end, an arrangement wherein the closed end is provided by a non-integral cap positioned and secured after the shaft has been fed axially through a hollow stem (which is internally frusto-conical to match the respective part of the shaft contour with which it is to mate, and with the diminishing section towards the open end).

If required, the internal surface of the stem can be provided with one or more projections which upon initial assembly of the head parts indent the shaft, and which permit accurate angular and axial re-alignment of a replaced (e.g. elliptical or oval) shaft in the stem upon subsequent re-assembly e.g. after replacing a worn socket piece.

Another widely-used design of split head hammer, usually for lower duty applications, follows the teaching of German GM8416694 and GM8416695. It includes a head formed of two parts split parallel to the shaft axis, the parts being connected by a single nut and bolt assembly located on the stem axis; this assembly is tightened until the sockets grip the striking pieces, but the gripping force has to be transmitted from the stem axis to the sockets, and to help ensure a grip sufficient to prevent the striking pieces from flying free under centrifugal force, the sockets are of an extended length (so reducing the volume of the striking piece available for useful work, whilst increasing the weight of socket material used), and internally ridged. We seek to avoid these disadvantages. Thus we connect the parts between the stem and each socket, the connection preferably being by a pair of nut and bolt assemblies positioned along the axis of the sockets, with one to either side of the stem; though in an alternative but less preferred embodiment we could use screws with tapped recesses. Usefully the parts will have aligned bolt receiving apertures, each terminating in a hexagonal recess, so that one recess can locate a nut whilst the other can receive a cap screw; an advantage of this arrangement, apart from the angular location of the nut during assembly and dis-assembly, is that each recess can be outside the axial projected area of the stem so that a strong beam section can be provided between a socket and the stem to help resist the input loads from the striking piece—the bolt-receiving apertures are provided in this beam section which also helps define the aforementioned socket base. We have found it desirable to shape the socket base to a deepening conical form, so that the beam section is initially of substantially constant depth (parallel to a socket axis) inwardly from the closed end of the stem and then deepening towards the open end of the stem, which is an advantageous design since many (mis-directed) hammer impacts are taken by the inward edge of a striking piece rather than "full face". Furthermore, the sockets are shaped to a frusto-conical form reducing in diameter to their open-end, to assist retention e.g. of a striking piece which we have designed to have a portion of reduced section and which spreads within the socket, after fitting in the socket, when compressed by impacts at its striking end, and/or which can be mechanically coupled to a socket and within the socket by a separate retaining member, conveniently annular.

The base and part of the socket surface are defined by the beam section, the beam section perpendicular to the stem axis having a greater depth along the axis of the sockets than has the stem wall in a direction at 90 degrees thereto; whilst the dimension at 45 degrees thereto is greater still. Providing the extra material only where it is needed permits we believe the head to have a greater capacity to absorb vibrations from the striking pieces to help cushion the shaft from these vibrations, and protect the user's hand.

Part of the beam section is outwardly extended; thus the head section between the stem and socket has a pair of outward extensions each parallel to the shaft axis, the connection between the said parts being by a threaded assembly comprising a nut and bolt, at least one of each nut and bolt being located in a recess in a respective outward extension. Preferably most or all of the recess is outside the tangent perpendicular to the major axis of the stem. The extension is less deep than the beam section.

Because our improved hammer design makes it suitable for heavy duty applications, it is particularly necessary to consider operator muscular reaction to the vibrations resulting from the hammer impact loads; these should both be kept to a minimum and so far as possible prevented from reaching the user's hands and arm, where they can cause discomfort, fatigue and perhaps muscular stress and injury. We thus provide shaft damping means in the form of a collar-like extension to the stem. It will be understood that by locating the stem behind the socket or between the sockets, the shaft in our invention is already supported over a longer length than for the known low duty hammer (as compared to one existing hammer with an extra 50% of supported length) so reducing the amplitude of the vibrations by a reduced input unit loading to the shaft. With our proposed stem extension, the enclosed length of shaft can be further increased. The stem thus includes a first portion aligned with the socket and a second portion extending therefrom, the second portion being at least one quarter and preferably between one third and one half of the length of the first portion. Preferably the second portion comprises a pair of part-cylindrical extension members each mounted respectively on a head part in cantilever so that they can act when necessary as individual damping members; i.e. the collar-like extension is spaced from the nut and bolt assemblies.

With wooden shafts in particular, despite the recognised need in the assembled hammer for the shaft to be tightly gripped, we have realised that care must be taken during assembly not to apply clamping loads (from the tightening of the head parts) of a magnitude sufficient to separate or force apart a significant proportion of the shaft fibres, so causing a substantial reduction in the shaft tensile strength. We have an improved stem to shaft geometry which can ensure a reliable grip on the shaft, by using dissimilar mating cross-sections. Thus according to a further feature of our invention we provide a split head hammer including a head comprising a first part and a second part, the parts being connected to form at least one striking piece socket and a hollow shaft-receiving stem, the connection between the parts being tightenable to reduce simultaneously the cross-section of the socket and of the stem respectively to grip firmly the striking piece and the shaft, the stem having an internal surface which engages the shaft at a plurality of circumferentially spaced positions, characterised in that during tightening the stem internal surface engages between one third and three quarters of a shaft circumference. Preferably for a wooden shaft, the stem engages 60–68% of a shaft circumference, for a high density polyethylene shaft 75%, and for a fibreglass shaft 60–65%; though for shafts e.g. of selected synthetic resinous materials, the stem may prior to head tightening engage as little as 10% of a shaft circumference, the minimum engagement area in each case being determined by the need to avoid stressing the material of the shaft beyond its elastic limit when the head parts are tightened so that the shaft can recover to or towards its initial size and shape upon subsequent release of the head parts i.e. so that the shaft (as well as the striking pieces) is again gripped tightly when one or both striking pieces are replaced and the head parts re-tightened. As a particular feature, to assist in correctly re-locating a shaft, the head parts can include bosses, preferably frusto-conical, which locate in indentations in the shaft, and whilst conveniently the indentations will have been formed during initial hammer assembly in the factory, replacement handles can be supplied ready-indented; the bosses can also help retain the handle in the hammer head.

For a conventionally-sized shaft with the usual elliptical cross section, we prefer the stem internal surface to comprise two part-circles, each with its centre to the respective far side of the stem axis; this arrangement provides four circumferentially spaced stem to shaft engagement positions, occupying about 65% of each respective shaft circumference and leaving 35% of the shaft circumference initially spaced from the stem internal surface. After tightening of the nut and bolt assemblies, with the resultant compressive forces being applied at the four symmetrically spaced positions, the shaft is compressed to reduce its contact diameter by about 2 mm, shaft material then undergoing we believe plastic flow into the spaces between the four compression locations. We have found that without these plastic flow areas, the compressive loading required to force a 2 mm contraction on shaft diameter cannot be accepted even by the high tensile bolt and nut assemblies we employ. But without such reduction in shaft diameter, at least at selected locations around the shaft circumference, adequate gripping of the striking pieces cannot be guaranteed, and this is a particular problem if the length of striking piece sunk within a socket is to be reduced (to limit the waste of striking piece material). We have found we can reduce the diameter of a wood shaft 10–15% without it being significantly weakened, using a mechanical interlock from dissimilar cross-sections, but without impalement; we have suggested that too high a mechanical compression will cause the fibres of the shaft to separate and perhaps split, with serious weakening of the shaft, and for certain woods we thus keep the compression below 10% when necessary, as easily determined by simple experiments and achieved by varying the percentage amount of the contact area.

For striking pieces such as those of malleable copper or aluminium, we believe it is desirable to provide an alternative gripping means to those currently available, to limit the length of striking piece needed simply for retention and thus also the depth of the sockets. In some current production designs a larger length socket has been provided when such striking pieces are to be used, but this results in a larger unused volume of material. Thus according to yet another feature of our invention we provide a hammer including a head comprising at least one striking piece socket, the socket having an open end to receive at least part of a malleable striking piece, and retaining means for the striking piece located between and engaged with said part and with the socket characterised in that the retaining means is positioned to sustain impact loading from the striking piece, the retaining means being adapted more firmly to retain the said part in the socket upon said impact loading. Preferably the said part is a rearward extension which is retained in the socket by an annular deformable ring. The annular ring can be of a cross-section to deform radially outwards along the socket base under axial impact loads, to behind the conventional socket retaining section; and in one embodiment the rearward extension is a column with a central recess and a splayed base-engaging end. In a preferred embodiment, an annular spring steel washer is located in the socket with its outer periphery at the junction between the base and the socket frusto-conical retaining wall, and its inner periphery against the cylindrical column, the washer penetrating the column and/or the column spreading around the washer upon a suitable loading of the striking piece e.g. an operational impact loading.

Preferably we use a toroidal mild steel ring around the cylindrical column. The column is inserted in the socket with its splayed end engaging the socket base, and with the ring located at the junction between the base and the socket retaining section, whereupon the sub-assembly is forced further into the socket, as by impact loading, until e.g. the splayed end spreads along the base behind the ring. The toroidal shape of the ring backs up the insert face of the striking piece so as to inhibit too great a volume of the striking piece flowing into the socket cavity. Thus the striking piece material is forced to change its shape with plastic deformation to allow firm retention in the socket, with economy of material; and yet can be easily removed (and replaced) upon the head parts being separated.

The invention will be described by way of example with reference to the accompanying drawings, in which.

Figure 2:
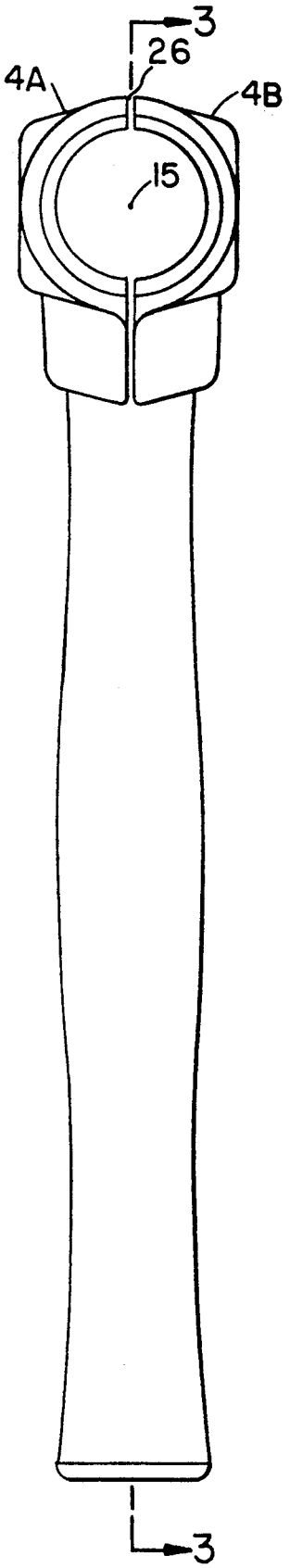
FIG. 2 is an end view corresponding to FIG. 1.
Figure 3:
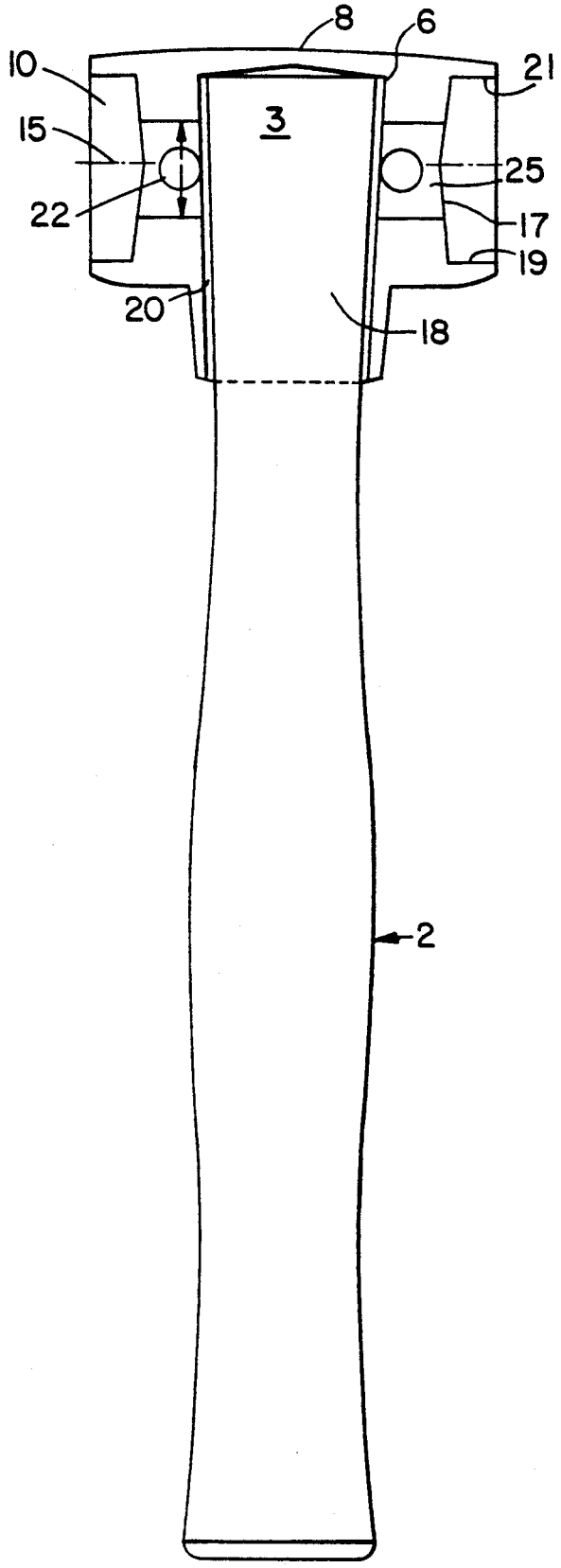
FIG. 3 is a sectional view on the line 3—3 of FIG. 2.
Figure 7:
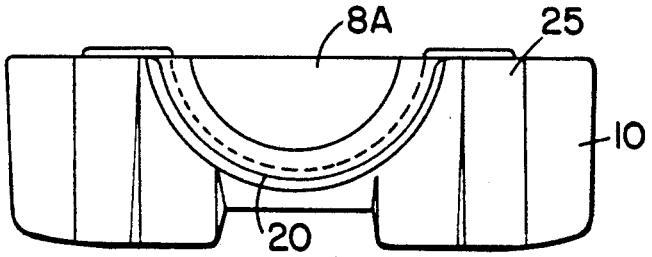
FIG. 7 is a view on the line 7—7 of FIG. 5.

The split head hammer includes an elliptical cross-section shaft 2 and a head 4. Hammer head 4 is assembled from identical parts 4A, 4B, secured together by nut and bolt assemblies 5. As best seen in FIG. 3, head 4 has a hollow receiving stem 6 effectively closed at one end by cover 8 formed by a pair of end members 8A (FIG. 7) respectively integral with parts 4*a*, 4*b* and spaced apart by gap 26 (FIG. 2); though in an alternative embodiment this one end of the stem can be fully closed by a separate end plate (not shown) secured to one or both head parts. The stem 6 is open at the other end to receive the shaft 2, the shaft 2 in use projecting out of this other end 18. Head 4 also has aligned, opposed sockets 10 (FIG. 3) to receive cylindrical striking pieces 11 e.g. of rolled rawhide. Stem 6 extends between sockets 10, and between nut and bolt assemblies 5 which are located to connect parts 4*a*, 4*b* between stem 6 and sockets 10, with assemblies 5 intersecting axis 15 of sockets 10.

The shaft 2 is typically of length 295 mm, and reduces in section from its head end 3 with a 2.4 degree taper for 83 mm, so that the major axis of the elliptical shaft 2 reduces from 32.5 mm to 27 mm, and the minor axis from 28 mm to 22.75 mm. Stem 6 is sunk 43 mm into head 4, which also includes an annular extension 12 for stem 6, the extension 12 being mounted in cantilever on head 4 at a position spaced from nut and bolt assemblies 5, and terminating 63 mm from the head end 3 to provide (when head parts 4A, 4B are assembled) a long supported shaft head length; the separate extensions 12 can add an anti-vibration or damping characteristic to shaft 2. The stem 6 has a frusto-conical internal surface 20 also with a taper of 2.4 degrees, the shaft 2 having a major diameter at the extension end of 28 mm and a minor diameter of 23.5 mm. Stem 6 can have locating projections 27 (FIGS. 5/5A) to help the user re-align shaft 2 during re-assembly, and which preferably are in the form of a pair of upstanding conical protrusions 27C (FIG. 5A) i.e. projecting inwardly of the hollow stem 6; though alternatively the projections 27 are ramps with faces 27A more steeply angled than faces 27B to bias the shaft with a wedging action towards the closed end of the hammer head.

The foot 14 of the shaft 2 has a major axis of 39 mm and a minor axis of 34.5 mm, whereas the hand-gripping area 16 has a major axis of 32 mm and a minor axis of 27.5 mm, which dimensions have been found suitable to permit a comfortable yet firm hand grip.

Each socket 10 includes a deepening conical base 17 and a frusto-conical wall 19 forming a retaining section for the received striking piece 11, and reducing in diameter towards the socket open end 21, which conveniently has a diameter of 36.75 mm.

It is a feature of our arrangement that the head parts 4A and 4B are identical, so simplifying manufacture, inventory control and replacement servicing. In use, the identical parts 4A, 4B are connected securely but releasably together by the nut and bolt assemblies 5, which pass through apertures 22 (FIG. 4), the nuts and cap screw heads being located in hexagonal recesses 24. When the striking pieces are trapped in sockets 10 formed by the parts 4A, 4B, these parts are out of contact, being separated by gap 26 of a size to ensure that the striking pieces are firmly gripped no matter how deformable or malleable the material of which they are made. Release of assemblies 5 allows one or both striking pieces to be replaced, or the shaft 2 to be replaced.

Figure 1:
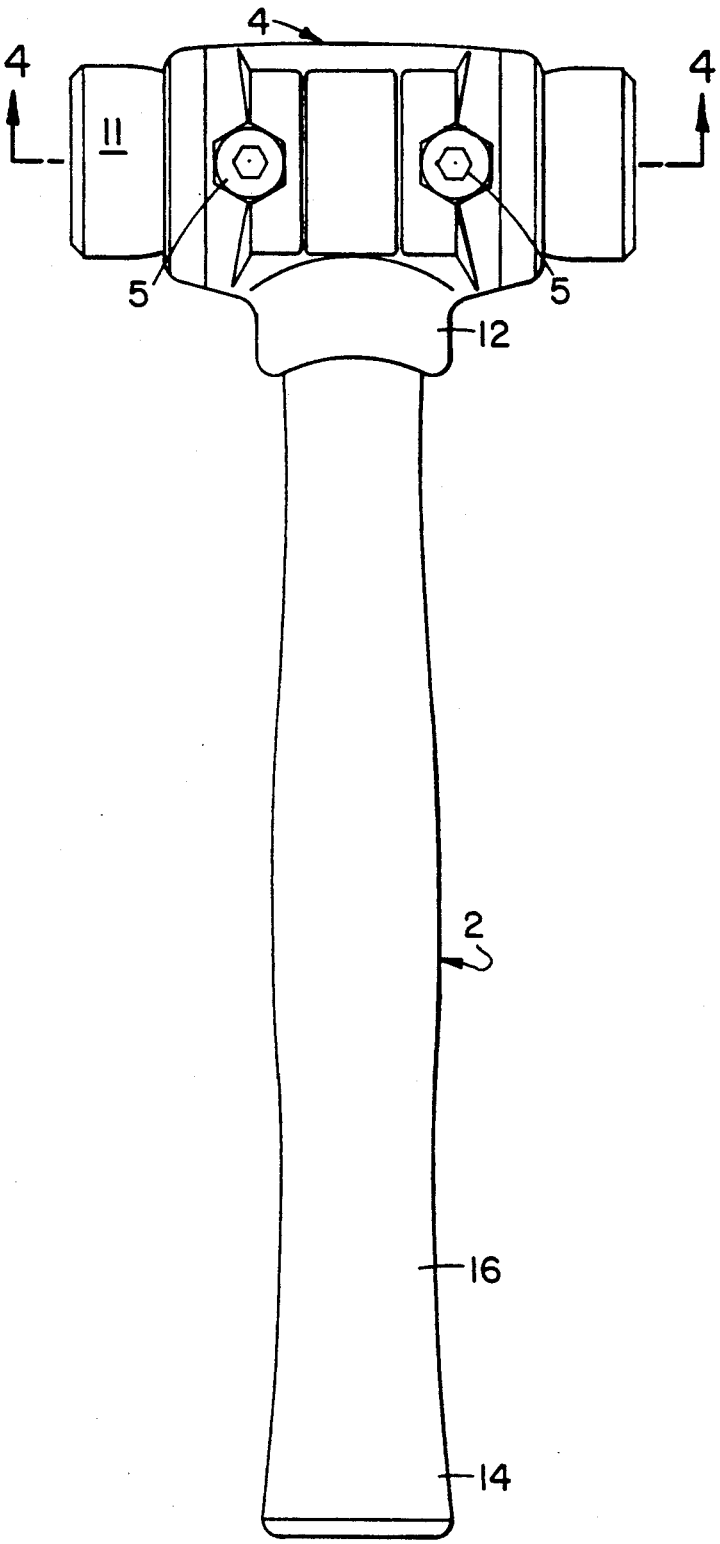
FIG. 1 is a side view of one embodiment of split head hammer according to the invention.
Figure 4:
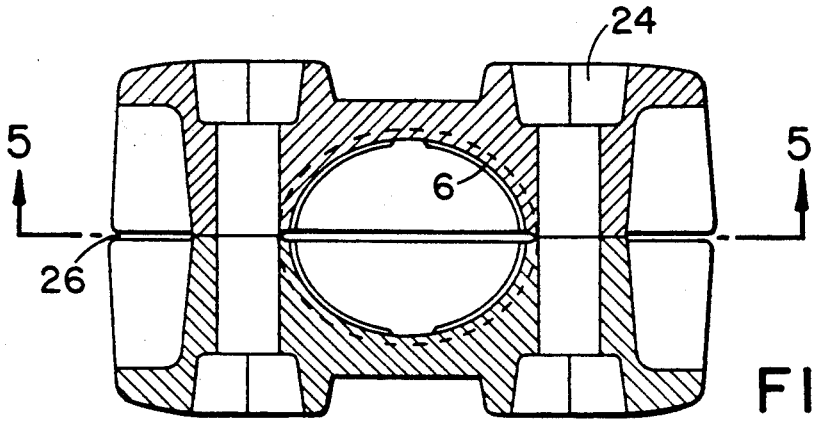
FIG. 4 is a partial view on the line 4—4 of FIG. 1, with the nut and bolt assemblies, and striking pieces omitted for clarity.
Figure 5:
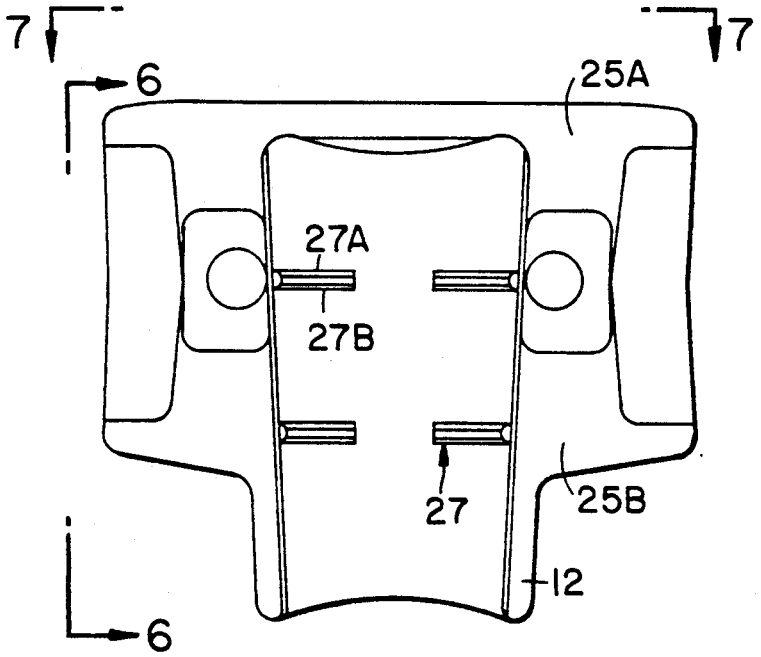
FIG. 5 is a view on the line 5—5 of FIG. 4.
Figure 6:
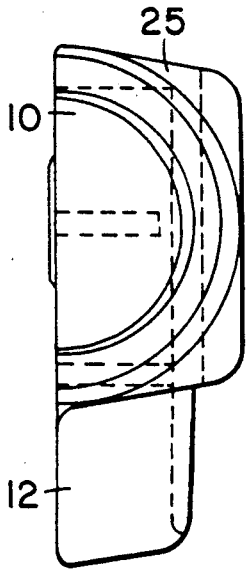
FIG. 6 is a view on the line 6—6 of FIG. 5.

As can be seen from FIG. 4, apertures 22 are outside the tangent to the major axis of stem 6, as is most of recess 24. As can be deduced and seen from FIGS. 1 and 3 respectively, apertures 22, and recess 24 into which they lead, and thus the nut and bolt assemblies 5 are on the centre line 15 of sockets 10. As can also be seen from FIG. 3, apertures 22 are in the beam section 25 defining the base 17 of socket 10, and part of the internal surface 20 of stem 6, the beam 25 thus being between the socket 10 and the stem 6. As seen in FIG. 4, the recesses 24 are outside the axially projected area of the stem 6. The beam sections 25 are of greater width W1 than the head section W2 therebetween in which is the stem 6. As seen in FIG. 5, because base 17 is conical beam section part 25A is of generally constant depth, whereas beam section part 25B increases in depth towards the open end 18 of stem 6 and extension 12. i.e. the beam section 25 has a greater depth in the direction of socket 10, adjacent open end 18 than adjacent closed end 8.

The striking piece 40A can have a cylindrical projection or column 46 (FIG. 8) with a central recess 48. This design is particularly suitable for a striking piece of a less malleable material such as copper or aluminium, particularly when used in conjunction with a tapered annular washer 50 located at its outer periphery at the junction between base 17 and wall 19 and at its inner periphery around column 46; when the surface 44 is impacted, the washer imbeds in the column 46 and/or the material of the column flows around the inner periphery of the trapped washer.

Figure 9:
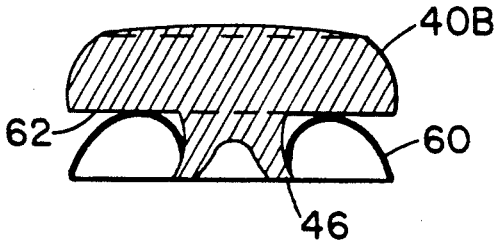
FIG. 9 is a side sectional view of a sub-assembly of side piece and toroidal ring.
Figure 10:
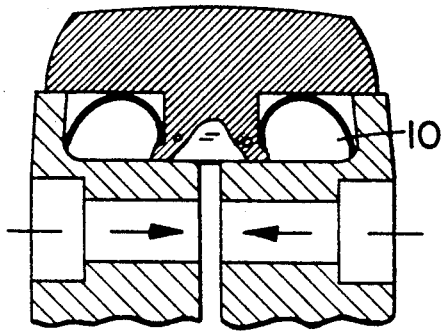
FIG. 10 is a side sectional view of the sub-assembly of FIG. 7 inserted in a socket.
Figure 11:
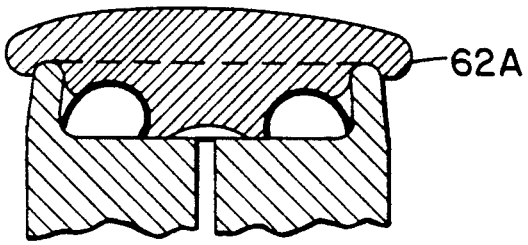
FIG. 11 is a side sectional view of the sub-assembly of FIG. 7 retained in the socket.

A particularly valuable embodiment is that of FIGS. 9–11, in which a toroidal mild steel ring 60 is positioned around column 46 of striking piece 40B is a sub-assembly (FIG. 9) prior to positioning in socket 10 (FIG. 10); substantially only column 46 is positioned in the socket 10. Following impacting into socket 10 (FIG. 11) the material of the striking piece 40B has been plastically deformed and so forced to change its shape, the deformation being controlled and exploited in that the ring 60 also has its configuration changed until it is securely retained both in the socket 10 and around the column 46 and behind the rear face 62 of the striking piece (the rear face 62 itself deforming with plastic flow along and around the ring 60, whilst the outer perimeter 62A may undergo plastic flow about the perimeter of the socket open end). The deformed retaining ring prevents too great a proportion of rear face 62 plastically deforming into socket 10, to avoid too great a reduction in the volume of striking piece 40B available for useful work. Thus we secure improved retention, yet with reduced wastage or loss of effective volume of striking piece material.

The split head hammer of our invention can thus be multi-use, since sockets 10 can accommodate a variety of striking piece materials, which can be readily changed when required for different applications, or exchanged when worn.

It will be understood that the above designs of striking piece are intended to permit a minimum length of striking piece to be used simply for retention in the head, which is a particularly valuable feature when the cost of e.g. copper is so high, and when therefor as great a proportion as possible of the striking piece must be available for useful work.

Figure 12:
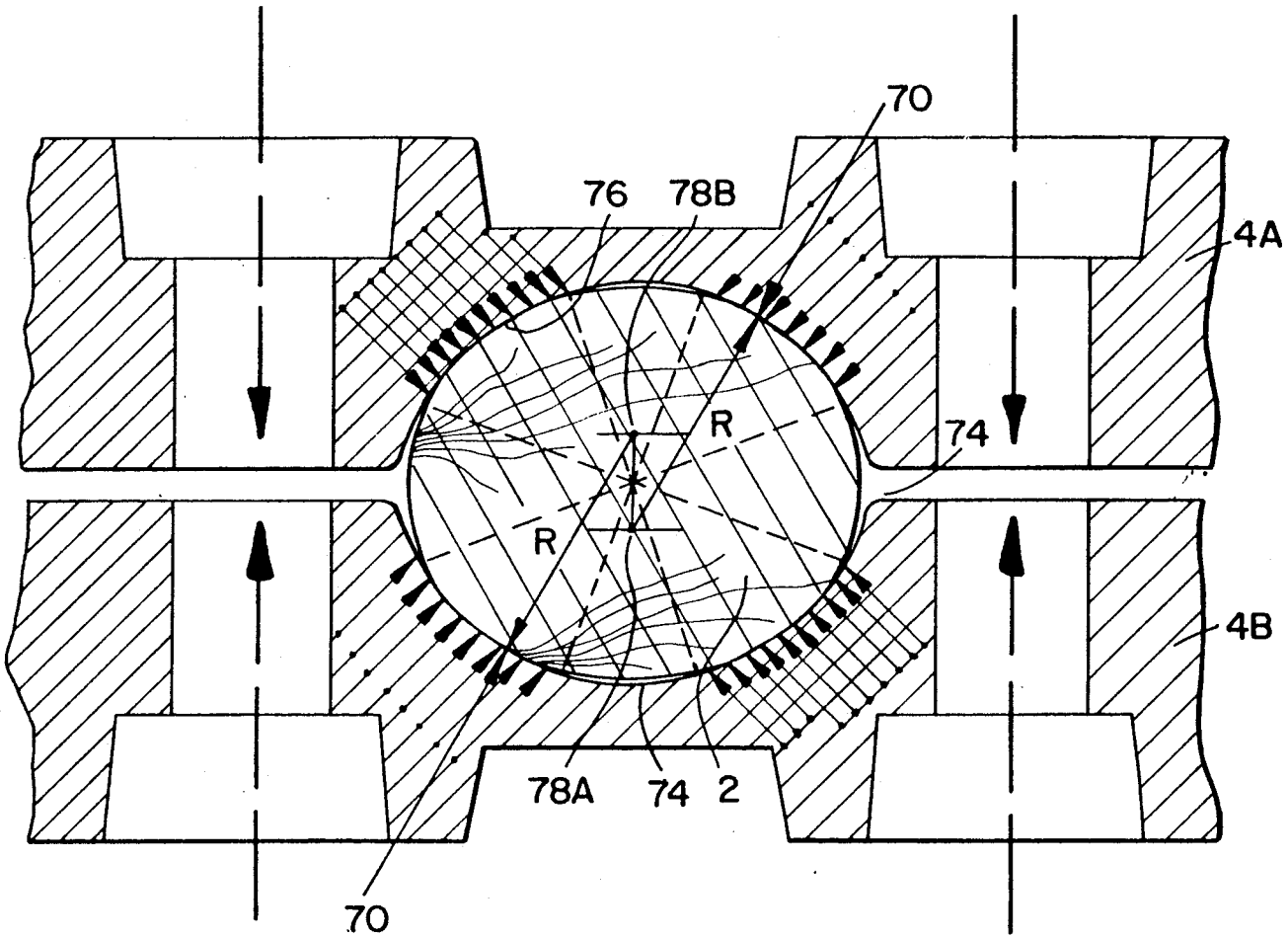
FIG. 12 is a view similar to that of FIG. 4, but with a handle in position, under partial compression.

As seen in FIG. 12, the shaft 2 is of wood and is of elliptical cross-section and is engaged by stem 6 at four angularly-spaced positions 70, which together initially engage 65% of the shaft circumference. When the head parts 4A, 4B are fully drawn together to grip the striking pieces 11, the material of shaft 2 extrudes or flows with plastic or equivalent deformation into the intervening spaces 74, initially representing 35% of the shaft 2 circumference. The internal surfaces 76 of head parts 4A, 4B are part-circular, each having a radius R about respective displaced centre 78A, 78B. The geometry of displaced part-circular head parts and an elliptical shaft permits a high compression loading to be applied to the shaft, sufficient not only for the shaft to be properly gripped with a controlled maximum loading so that it is not weakened by internal rupture, but also with the required loading being applied to the striking pieces, perhaps with a set loading to the striking pieces, and a varied loading to the shaft (in accordance with the dimensions, tolerances, durability etc. of the different striking pieces used) accompanied by plastic flow into spaces 74.

Figure 5A:
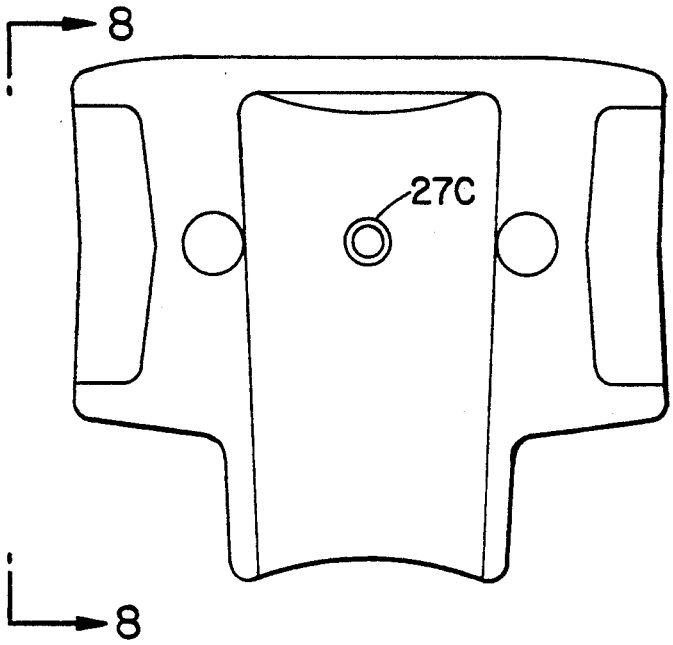
FIG. 5A is a view corresponding to FIG. 5, but of an alternative embodiment.
Figure 6A:
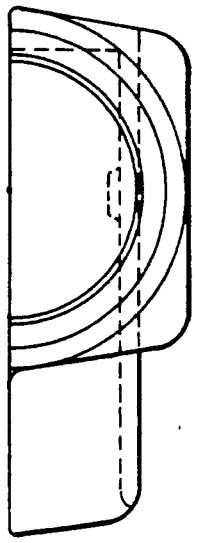
FIG. 6A is a view on the line 8—8 of FIG. 5A.

In FIG. 5A, a pair of frusto-conical locators 27 are shown, which in use are in an intervening space 74. The locators 27C are in the form of bosses which engage in indentations in the shaft to help locate the shaft axially and angularly e.g. when the head parts 4A, 4B are being re-connected after replacement of a striking piece. In an alternative embodiment to that of FIG. 5, the locators 27 will extend axially, and also will be positioned in the intervening spaces 74 (FIG. 12), and so not contributing to or not substantially contributing to the axial location of the shaft 2 in head 4.

Figure 8:
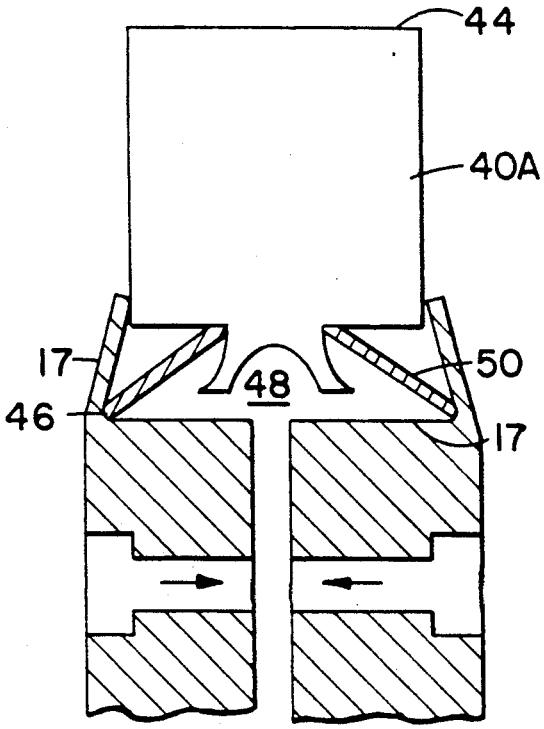
FIG. 8 is a side view of an improved design of striking piece, with annular washer retention.

The striking piece arrangement of FIG. 8 is particularly useful in split head hammers, since the heads 4A, 4B, can be released to ease removal of the inbedded washer 50. However, we forsee that this embodiment could also be used with a conical socket 10 i.e. since the frusto-conical retaining walls 19 of the FIG. 8 embodiment are not essential to a firm retention of the striking piece 40A in the socket, this arrangement using an annular washer can be used with a variety of socket designs. Specifically, we foresee a considerable usage with solid head hammers (i.e. non-split) where it is already the practice to "chisel out" the worn striking piece, so that in our proposal the striking piece would be positioned in the solid head with the reduced section mechanically coupled to the socket by a separate retaining member such as the disclosed annular rings or e.g. radial fingers. The striking piece 40A and washer 50 could for the solid head and split head hammers if required be provided as a sub-assembly (as anticipated in FIG. 8) or separately. It will also be understood that the problem of removing striking pieces from existing socket designs, many of which require the socket to be swaged onto the striking piece and/or for the side wall 19 to have upstanding projections for striking piece retention, is often accentuated by the tight initial engagement needed to allow for any subsequent relaxation or spreading of the side walls 19. It is thus an advantage of our embodiment of FIGS. 9–11 that outer perimeter 62A flows around the socket end to inhibit outward spreading of the open end of the socket.

The annular ring 60 of the FIG. 9–11 embodiment is selected by simple experiment to have small resistance to curling i.e. towards and away from its axis (FIG. 10 to FIG. 11), but a high resistance to axial compression to provide a barrier against inward flow of striking piece material under usage impacts. The length of the column 46 can thus be reduced, with a further saving of the volume of material used for retention of striking piece 40B. As with the embodiment of FIG. 8, the striking piece 40B is self-locking in the socket, upon initial impact(s) at surface 44.

I claim:

1. A split head hammer which includes a head and a shaft, the head comprising a first part and a second part, means for releasably and adjustably connecting together said head parts, said parts when connected together defining a pair of axially aligned oppositely opening striking piece sockets and a hollow shaft receiving stem having an open end and a closed end, said stem having a larger cross sectional area at the closed end than at the open end, said stem extending behind and beyond the axes of said sockets, said shaft having an end received in and substantially filling said stem, striking members received in said sockets, said connecting means comprising a pair of tightenable connectors releasably engaging said parts on opposite sides of said stem, said stem having an internal circumferential contact surface and said end of said shaft having an external circumferential contact surface of different shape than said internal surface such that when said shaft end is positioned in said stem said internal surface of said stem engages between one third and three quarters of the shaft end external surface, the portion of the shafts external surface received within said stem but not engaged by the internal surface thereof defining with said internal surface initially unoccupied space arranged that upon tightening of said connectors the cross section of said stem and said sockets are reduced and said shaft end within said stem deforms into said initially unoccupied space to enable said sockets and said stem to clamp said shaft end in said stem and said striking pieces in said sockets against axial separation from said parts.

2. A split head hammer according to claim 1 wherein the closed end is formed by a pair of end members integral respectively with the first part and second part.

3. A split head hammer according to claim 1 wherein the first part and the second part are identically-shaped.

4. A split head hammer according to claim 1 wherein said tightenable connectors comprise a pair of nut and bolt assemblies, and wherein the said first and second parts each include a beam section, each beam section defining part of a base of each of said striking piece sockets and part of the stem, each beam section having a greater depth adjacent the open end of the stem than adjacent the closed end, an aperture in each said beam section, a bolt of each nut and bolt assembly being received in a said aperture.

5. A split head hammer according to claim 1 wherein the first part and the second part each include an extension each mounted in cantilever on a respective one of said parts at a position spaced from the said connection assemblies.

6. A split head hammer in accordance with claim 1 wherein said open end of said stem is on one side of a common axis for said sockets and said closed end of said stem is on the other side of the common axis of said sockets, said stem extending behind and to either side of said common axis of said sockets.

7. A split head hammer which includes a head and a shaft of deformable material, the head comprising a first part and a second part and a connection between said parts said parts when connected together forming at least one striking piece socket and a hollow stem in which said shaft is received, a striking piece in said at least one striking piece socket, said connection between said parts being tightenable to reduce simultaneously the cross-section of said socket and stem to grip firmly said striking piece and said shaft respectively, said stem having an internal contact surface and said shaft having an external contact surface, said surfaces having dissimilar shapes whereby said stem initially engages said shaft at a plurality of circumferentially-spaced positions, leaving unoccupied space between said positions arranged that upon tightening said connection, said shaft material deforms into said space to increase engagement between said internal contact surface of said stem with said external contact surface of said shaft.

8. A split head hammer according to claim 7 wherein the shaft is of elliptical cross-section and is initially engaged by the stem at four angularly-spaced positions comprising 65% of the said shaft circumference.

9. A split head hammer according to claim 10 wherein the said component is an annular deformable ring, wherein the striking piece is of mushroom shape having a striking piece head and a striking piece extension, the striking piece extension being of smaller cross-section than the striking piece head, and wherein the annular ring is located about the striking piece extension.

10. A hammer including a head comprising at least one striking piece socket in the head, said socket having a socket base and an annular socket sidewall, said sidewall having at its one end a junction with said base and at its other end an open socket end, said open socket end being sized to receive at least a part of a malleable striking piece and retaining and impact transmitting means for the striking piece located between and engaged with said part of said malleable striking piece and with said junction for sustaining impact loading from said striking piece and for firmly retaining said part within said socket in response to said impact loading.

11. A split head hammer according to claim 10 wherein said part of said malleable striking piece is a striking piece rearward extension, and said retaining and impact transmitting means is an annular deformable ring.

12. A hammer including a head and a shaft connected to said head, said head comprising (a) at least one hollow striking piece socket, said socket having an interior surface terminating in an open end, said interior surface and said open end being sized to receive a part of a malleable striking piece, (b) retaining means for the striking piece located between and engaged with both said part of said malleable striking piece and with said interior surface of said socket, and (c) impact transmitting means to transmit a major proportion of the impact loads from the striking piece to the interior surface of said socket, wherein a single component provides both the retaining means and the impact transmitting means.

* * * * *